US009267391B2

(12) United States Patent
Vijayan et al.

(10) Patent No.: US 9,267,391 B2
(45) Date of Patent: Feb. 23, 2016

(54) DIFFUSER ASSEMBLIES HAVING AT LEAST ONE ADJUSTABLE FLOW DEFLECTING MEMBER

(71) Applicant: General Electric Company, Schenectady, NY (US)

(72) Inventors: Santhosh Kumar Vijayan, Bangalore (IN); Deepesh D Nanda, Bangalore (IN)

(73) Assignee: General Electric Company, Schenectady, NY (US)

( * ) Notice: Subject to any disclaimer, the term of this patent is extended or adjusted under 35 U.S.C. 154(b) by 579 days.

(21) Appl. No.: 13/724,137

(22) Filed: Dec. 21, 2012

(65) Prior Publication Data

US 2014/0178191 A1 Jun. 26, 2014

(51) Int. Cl.

| | |
|---|---|
| ***F01D 17/14*** | (2006.01) |
| *F02D 9/04* | (2006.01) |
| *F01D 25/30* | (2006.01) |
| *F01D 17/16* | (2006.01) |

(52) U.S. Cl.

CPC ..... *F01D 17/143* (2013.01); *F01D 17/14* (2013.01); *F01D 17/16* (2013.01); *F01D 25/30* (2013.01); *F02D 9/04* (2013.01); *F05D 2270/17* (2013.01)

(58) Field of Classification Search

CPC ..... F01D 17/14; F01D 17/143; F01D 17/16; F01D 25/30; F02D 9/04; F02K 1/28; F02K 1/30; F02K 1/34

See application file for complete search history.

(56) References Cited

U.S. PATENT DOCUMENTS

| | | | | |
|---|---|---|---|---|
| 4,682,746 | A * | 7/1987 | Thomas | 244/207 |
| 8,146,341 | B2 * | 4/2012 | Siden et al. | 60/39.182 |
| 2010/0089031 | A1 * | 4/2010 | Wells et al. | 60/228 |
| 2013/0152592 | A1 * | 6/2013 | Orosa et al. | 60/772 |

* cited by examiner

*Primary Examiner* — Craig Kim

(74) *Attorney, Agent, or Firm* — Sutherland Asbill & Brennan LLP

(57) ABSTRACT

A diffuser assembly is provided herein. In certain embodiments, the diffuser assembly may include an outer boundary member and an inner boundary member, with the inner boundary member being positioned radially inward of the outer boundary member. The diffuser assembly also may include an exhaust flow path defined between the outer boundary member and the inner boundary member. Further, the diffuser assembly may include at least one flow deflecting member operatively attached to the outer boundary member. The flow deflecting member may be adjustable about the outer boundary member to produce a substantially uniform velocity distribution within the exhaust flow path.

18 Claims, 4 Drawing Sheets

DIFFUSER ASSEMBLIES HAVING AT LEAST ONE ADJUSTABLE FLOW DEFLECTING MEMBER

FIELD OF THE DISCLOSURE

Embodiments of the present disclosure relate generally to gas turbine engines and more particularly to diffuser assemblies including at least one flow deflecting member.

BACKGROUND OF THE DISCLOSURE

Gas turbine engines are widely utilized in fields such as power generation. A conventional gas turbine engine may include a compressor, a combustor, and a turbine. The compressor may supply compressed air to the combustor, where the compressed air may be mixed with fuel and burned to generate a working fluid. The working fluid may be supplied to the turbine, where energy may be extracted from the working fluid to produce work. The working fluid may exit the turbine via an exhaust section having a diffuser assembly.

At partial loads, the total pressure profile of the working fluid at the inlet of diffuser assembly is generally tip (i.e., outer wall) strong. A tip strong profile causes flow separation at the inner wall (i.e., hub side of the diffuser assembly). The skewed profile does not allow the working fluid to distribute evenly in the diffuser assembly, thus reducing the diffuser assembly performance. Moreover, skewed or non-uniform velocity profiles deteriorate the performance of the heat recovery steam generator (HRSG) assembly positioned downstream of the diffuser assembly, which leads to premature failure or damage of the HRSG assembly. Accordingly, there is a need to produce a substantially uniform velocity distribution of the working fluid within the exhaust flow path of the diffuser assembly, which in turn may be supplied to the HRSG assembly.

BRIEF DESCRIPTION OF THE DISCLOSURE

Some or all of the above needs and/or problems may be addressed by certain embodiments of the present disclosure. According to an embodiment, there is disclosed a diffuser assembly. The diffuser assembly may include an outer boundary member and an inner boundary member positioned radially inward of the outer boundary member. The diffuser assembly also may include an exhaust flow path defined between the outer boundary member and the inner boundary member. Further, the diffuser assembly may include at least one flow deflecting member operatively attached to the outer boundary member. The flow deflecting member may be adjustable about the outer boundary member to produce a substantially uniform velocity distribution within the exhaust flow path.

According to another embodiment, there is disclosed a method for use with a gas turbine engine. The method may include flowing a fluid in an exhaust flow pathway defined between an outer boundary member and an inner boundary member. Moreover, the method may include adjusting at least one flow deflecting member operatively attached to the outer boundary member to produce a substantially uniform velocity distribution within the exhaust flow path.

Further, according to another embodiment, there is disclosed a gas turbine system. The system may include a turbine assembly, an exhaust diffuser assembly in communication with the turbine assembly, and a HRSG assembly in communication with the exhaust diffuser assembly. The exhaust diffuser assembly may include an outer boundary member and an inner boundary member positioned radially inward of the outer boundary member. The exhaust diffuser assembly also may include an exhaust flow path defined between the outer boundary member and the inner boundary member. Moreover, the exhaust diffuser assembly may include at least one flow deflecting member operatively attached to the outer boundary member. The flow deflecting member may be adjustable about the outer boundary member to produce a substantially uniform velocity distribution within the exhaust flow path. The substantially uniform velocity distribution may be supplied to the HRSG assembly.

Other embodiments, aspects, and features of the disclosure will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments will now be described more fully hereinafter with reference to the accompanying drawings, in which some, but not all embodiments are shown. The present disclosure may be embodied in many different forms and should not be construed as limited to the embodiments set forth herein. Like numbers refer to like elements throughout.

Illustrative embodiments are directed to, among other things, a gas turbine engine system including a diffuser assembly. In certain embodiments, the diffuser assembly may be associated with the exhaust of a turbine. That is, the diffuser assembly may include an exhaust flow path defined between an outer boundary member (i.e., an outer radial wall) and an inner boundary member (i.e., an inner radial wall or hub). The diffuser assembly also may include one or more flow deflecting members (e.g., a single deflecting plate or a number of deflecting plates) operatively attached to the outer boundary member. That is, the flow deflecting member may be adjustable about the outer boundary member to produce a substantially uniform velocity distribution within the exhaust flow path. For example, in some instances, the flow deflecting member may be rotatably attached (e.g., via a pivot or the like) to the outer boundary such that the flow deflecting member may extend at least partially into the exhaust flow path. In other instances, however, the flow detecting member may be wholly or partially positioned within a housing such that the flow deflecting member is substantially flush with the outer boundary member.

In certain embodiments, an actuator may be in operative communication with the flow deflecting member. In this manner, the actuator may be configured to rotate (i.e., extend) the flow deflecting member at least partially into the exhaust flow path. Conversely, the actuator also may be configured to rotate (i.e., retract) the flow deflecting member into the housing.

One or more struts may be positioned within the exhaust flow path between the outer boundary member and the inner boundary member. In some instances, the flow deflecting member may be positioned downstream of the struts. Moreover, the flow deflecting member may include one or more apertures therethrough. For example, the apertures may include a plurality of holes or a plurality of slots. Further, the flow deflecting member may include one or more protrusions. In some instances, the flow deflecting member may include a plate-like structure or the like, although other configurations are within the scope of the disclosure.

In certain embodiments, the flow deflecting member may reduce the tip strong nature of the exhaust flow and improve the diffuser assembly performance at partial loads. That is, the flow deflecting member may divert at least a portion of the exhaust flow towards the inner boundary member (i.e., the hub region) of the diffuser assembly, thereby utilizing the entire diffuser assembly domain for pressure recovery.

Figure 1:
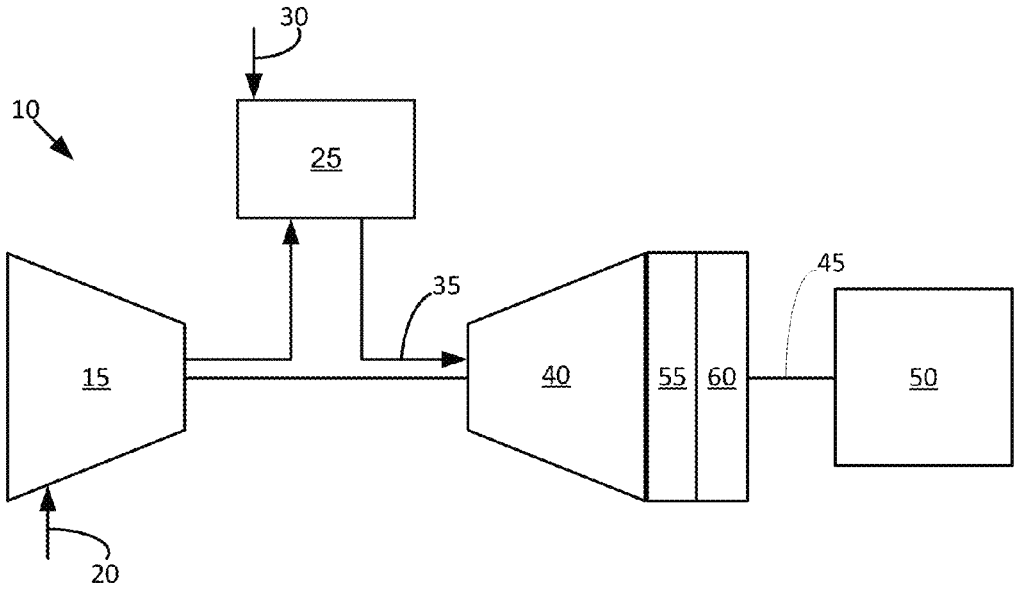
FIG. 1 is a schematic view of an example diagram of a gas turbine engine, according to an embodiment of the disclosure.

Turning now to FIG. 1, which depicts a schematic view of an example embodiment of a gas turbine engine 10 as may be used herein. For example, the gas turbine engine 10 may include a compressor 15. The compressor 15 may compress an incoming flow of air 20. The compressor 15 may deliver the compressed flow of air 20 to a combustor 25. The combustor 25 may mix the compressed flow of air 20 with a pressurized flow of fuel 30 and ignite the mixture to create a flow of combustion gases 35. Although only a single combustor 25 is shown, the gas turbine engine 10 may include any number of combustors 25. The flow of combustion gases 35 in turn may be delivered to a turbine 40. The flow of combustion gases 35 may drive the turbine 40 so as to produce mechanical work. The mechanical work produced in the turbine 40 may drive the compressor 15 via a shaft 45 and an external load 50 such as an electrical generator or the like. The flow of combustion gases 35 may exit the turbine 40 via an exhaust system 55. The flow of combustion gases 35 exiting the exhaust system 55 may be supplied to at least one HRSG assembly 60. The HRSG assembly 60 may recover heat from flow of combustion gases 35 exiting the exhaust system 55 and employ the heat to create steam for expansion in a steam engine or the like. The steam engine may drive an external load, such as an electrical generator or the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine or the like. The gas turbine engine 10 may have different configurations and may use other types of components. Moreover, other types of gas turbine engines also may be used herein. Multiple gas turbine engines, other types of turbines, and other types of power generation equipment also may be used herein together.

Figure 2:
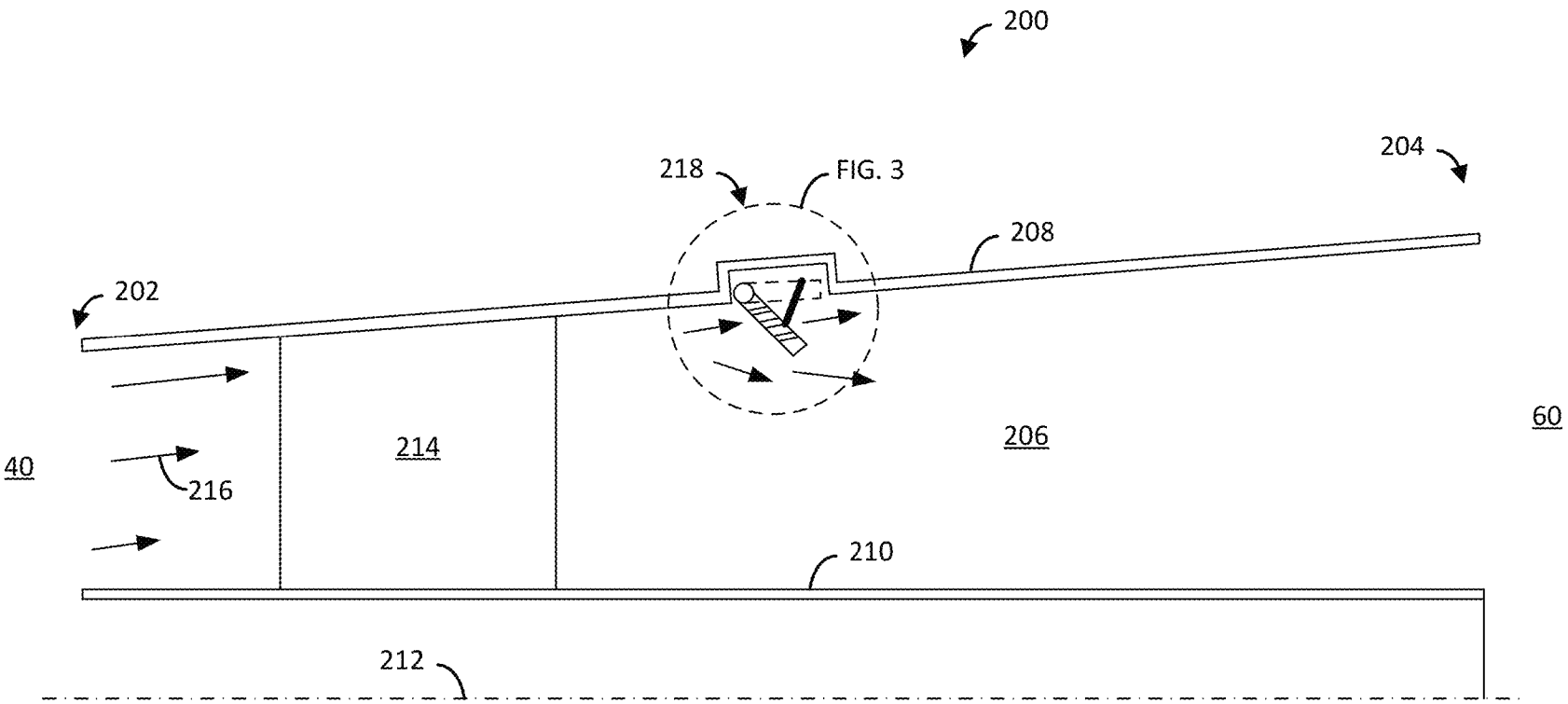
FIG. 2 is a schematic cross-sectional view of a portion of a diffuser assembly, according to an embodiment of the disclosure.

Referring to FIG. 2, there is depicted a schematic cross-sectional view of a portion of a diffuser assembly 200 that may be associated with an exhaust system, such as the exhaust system 55 of FIG. 1. The diffuser assembly 200 may include an inlet 202 and an outlet 204. Moreover, the diffuser assembly 200 may include an exhaust flow path 206 defined between an outer boundary member 208 and an inner boundary member 210. That is, the outer boundary member 208 may define a radially outer wall of the diffuser assembly 200, and the inner boundary member 210 may define a radially inner wall or hub portion (relative to the outer wall) of the diffuser assembly 200. For example, the outer boundary member 208 and the inner boundary member 210 may extend axially about a centerline 212. In certain embodiments, one or more struts 214 may be disposed within the exhaust flow path 206. The struts 214 may extend between the outer boundary member 208 and the inner boundary member 210.

The inlet 202 may be configured to receive a flow of combustion gases 216. The flow of combustion gases 216 may flow from the inlet 202 to the outlet 204 along the exhaust flow path 206 between the outer boundary member 208 and the inner boundary member 210.

As noted above, in some instances, the total pressure profile of the flow of combustion gases 216 at the inlet 202 of diffuser assembly 200 may be generally tip (i.e., the outer boundary member 208) strong. A tip strong profile causes flow separation at the inner boundary member 210 (i.e. hub side of the diffuser assembly 200). The skewed profile does not allow the flow of combustion gases 216 to distribute evenly in the diffuser assembly 200, thus reducing the diffuser assembly 200 performance. Accordingly, in order to produce a substantially uniform velocity distribution of the flow of combustion gases 216 within the exhaust flow path 206, a flow deflecting member 218 may be operatively attached to the outer boundary member 208. In this manner, the flow deflecting member 218 may be configured to deflect (or direct) at least a portion of the flow of combustion gases 216 away from the outer boundary member 208 to produce a substantially uniform velocity distribution of the flow of combustion gases 216 within the exhaust flow path 206. In this manner, the substantially uniform velocity distribution of the flow of combustion gases 216 may be supplied to the HRSG assembly 60 of FIG. 1, which enhances the performance of the HRSG assembly 60. In some instances, the flow deflecting member 218 may be positioned downstream of the struts 214.

Figure 3:
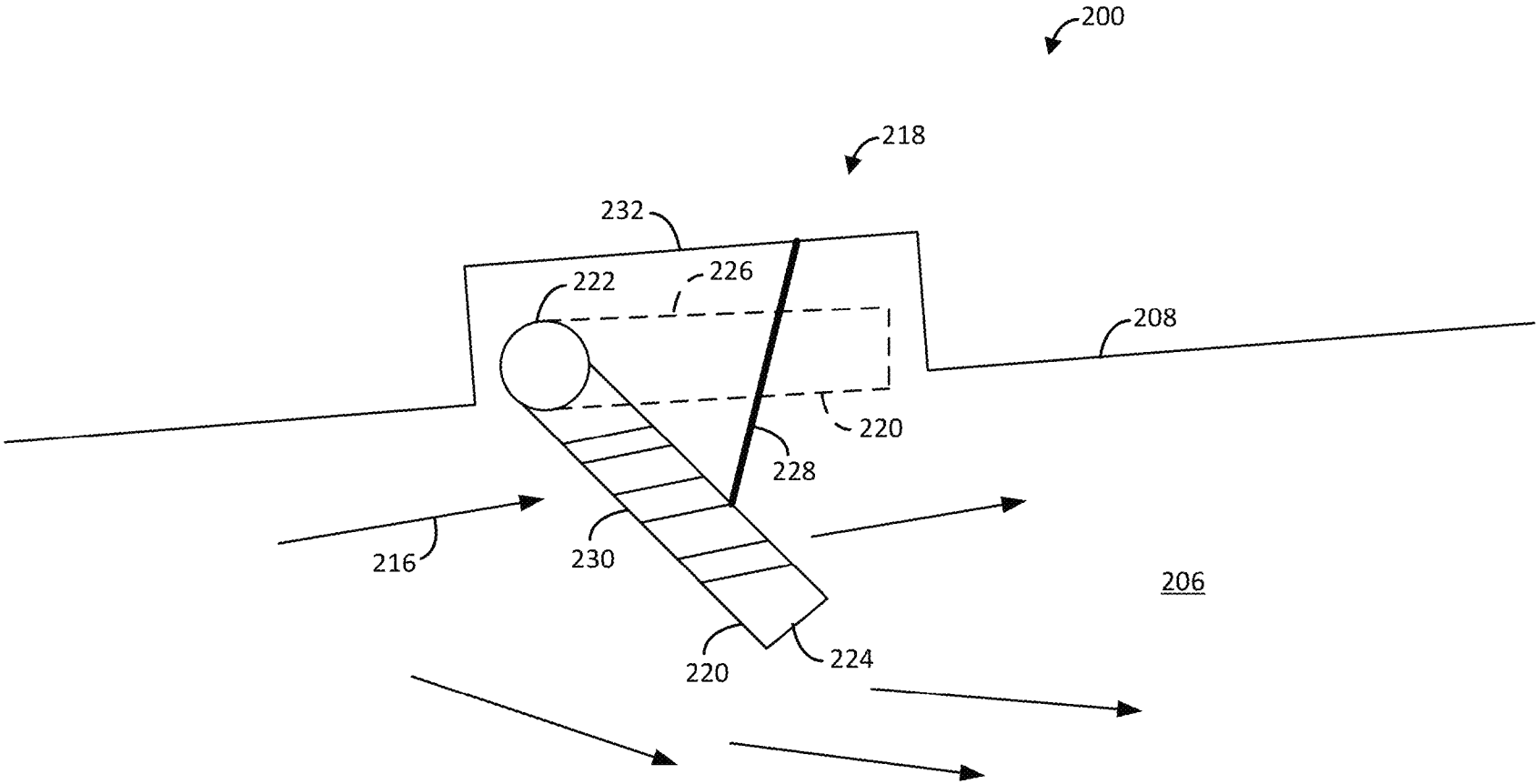
FIG. 3 is a schematic cross-sectional view of a portion of a diffuser assembly, according to an embodiment of the disclosure.

As depicted in FIG. 3, which is a schematic cross-sectional view of a portion of the diffuser assembly 200 of FIG. 2, the flow deflecting member 218 may be adjustable about the outer boundary member 208. Any number of flow deflecting members 218 may be used herein. In some instances, the flow deflecting member 218 may include a plate 220 that is rotatably attached, via a pivot 222 or the like, to the outer boundary 208. The rotatable configuration of the flow deflecting member 218 enables the flow deflecting member 218 to be extended at least partially into the exhaust flow path 206. In this manner, the flow deflecting member 218 may include a first position 224 extending at least partially into the exhaust flow path 206 and a second position 226 flush with the outer boundary member 208. An actuator 228 may be configured to actuate the flow deflecting member 218 between the first position 224 and the second position 226.

In some instances, the flow deflecting member 218 may include one or more apertures 230 extending therethrough. That is, the plate 220 may include a number of apertures 230. The apertures 230 may enable at least a portion of the flow of combustion gases 216 to pass through the plate 220, while at least another portion of the flow of combustion gases 216 may be deflected from the outer boundary member 208 to produce a substantially uniform velocity distribution of the flow of combustion gases 216 within the exhaust flow path 206, which is supplied to the HRSG assembly 60 of FIG. 1.

In certain embodiment, the diffuser assembly 200 may include a housing 232. The housing 232 may be positioned about the outer boundary member 208. The housing 232 may be configured to at least partially house the flow deflecting member 218 when in the second position 226 (i.e., the retracted position) flush with the outer boundary member 208.

Figure 4A:
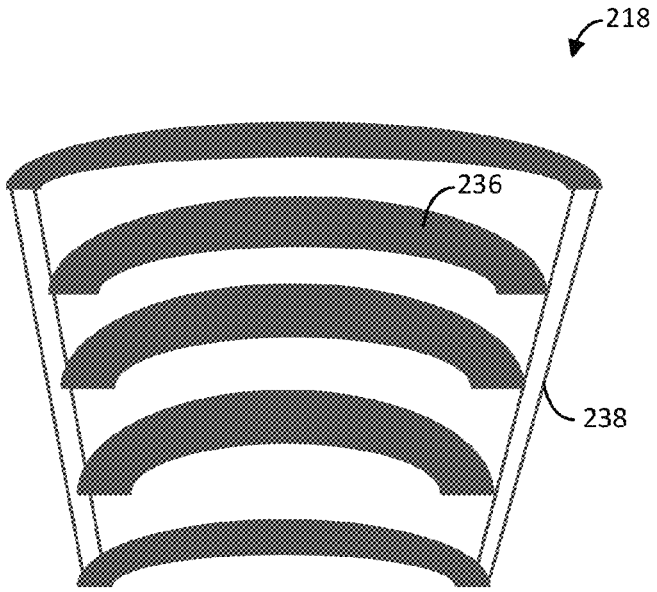
FIG. 4A is a schematic perspective view of a portion of a flow deflecting member, according to an embodiment of the disclosure.
Figure 4B:
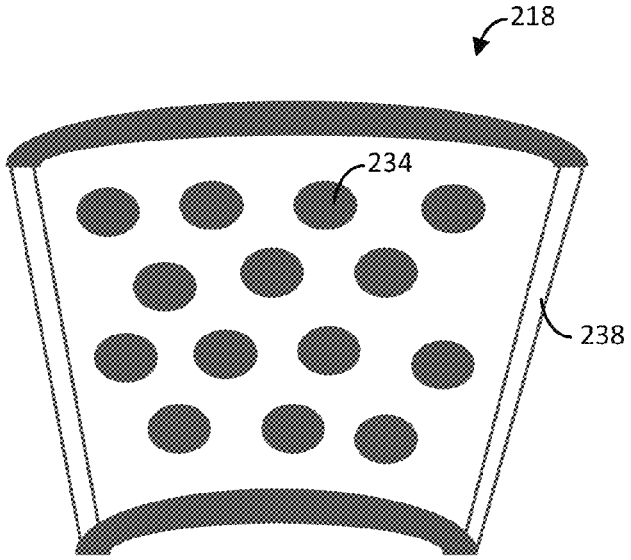
FIG. 4B is a schematic perspective view of a portion of a flow deflecting member, according to an embodiment of the disclosure.

FIGS. 4A and 4B illustrate a schematic perspective view of a portion of the flow deflecting member 218, according to one or more embodiments. As noted above, in some instances, the flow deflecting member 218 may include one or more apertures 230 extending therethrough. For example, the apertures 230 may include a number of holes 234 or a plurality of slots 236. Alternatively, or in addition to, the flow deflecting member 218 may include one or more protrusions. In some instances, the flow deflecting member 218 may include a plate-like structure 238 or the like, although other configurations are within the scope of the disclosure. Moreover, a single flow deflecting member 218 and/or a plurality of flow deflecting member 218 may be used herein.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A diffuser assembly, comprising:

an outer boundary member;

an inner boundary member positioned radially inward of the outer boundary member and defining an exhaust flow path therebetween; and at least one flow deflecting member operatively attached to the outer boundary member, wherein the flow deflecting member comprises one or more apertures therethrough, which enable at least a portion of a flow of combustion gases within the exhaust flow path to pass through the flow deflecting member, while at least another portion of the flow of combustion gases is deflected from the outer boundary member by the flow deflecting member to produce a substantially uniform velocity distribution of the flow of combustion gases within the exhaust flow path.

2. The diffuser assembly of claim 1, wherein the flow deflecting member comprises a first position extending at least partially into the exhaust flow path and a second position flush with the outer boundary member.

3. The diffuser assembly of claim 1, further comprising a pivot operatively attaching the flow deflecting member to the outer boundary member.

4. The diffuser assembly of claim 1, further comprising a housing positioned about the outer boundary member, wherein the housing is configured to at least partially house the flow deflecting member.

5. The diffuser assembly of claim 1, further comprising an actuator in operative communication with the flow deflecting member.

6. The diffuser assembly of claim 1, further comprising at least one strut disposed within the exhaust flow path between the outer boundary member and the inner boundary member, wherein the flow deflecting member is positioned downstream of the at least one strut.

7. The diffuser assembly of claim 1, wherein the one or more apertures comprise a plurality of holes.

8. The diffuser assembly of claim 1, wherein the one or more apertures comprise a plurality of slots.

9. The diffuser assembly of claim 1, wherein the flow deflecting member comprises one or more protrusions.

10. A method for use with a gas turbine engine, comprising:

flowing a fluid in an exhaust flow pathway defined between an outer boundary member and an inner boundary member;

adjusting a position of at least one flow deflecting member operatively attached to the outer boundary member, wherein the flow deflecting member comprises one or more apertures therethrough; and producing a substantially uniform velocity distribution of the fluid flow within the exhaust flow path, wherein the one or more apertures enable at least a portion of the fluid flow within the exhaust flow pathway to pass through the flow deflecting member, while at least another portion of the fluid flow is deflected from the outer boundary member by the flow deflecting member to produce the substantially uniform velocity distribution of the fluid flow within the exhaust flow path.

11. A gas turbine system, comprising:

an HRSG assembly;

a turbine assembly; and an exhaust diffuser assembly in communication with the turbine assembly and the HRSG assembly, the exhaust diffuser assembly comprising:

an outer boundary member;

an inner boundary member positioned radially inward of the outer boundary member defining an exhaust flow path therebetween; and at least one flow deflecting member operatively attached to the outer boundary member, wherein the flow deflecting member comprises one or more apertures therethrough, which enable at least a portion of a flow of combustion gases within the exhaust flow path to pass through the flow deflecting member, while at least another portion of the flow of combustion gases is deflected from the outer boundary member by the flow deflecting member to produce a substantially uniform velocity distribution of the flow of combustion gases within the exhaust flow path, which is supplied to the HRSG assembly.

12. The gas turbine system of claim 11, wherein the flow deflecting member comprises a first position extending at least partially into the exhaust flow path and a second position flush with the outer boundary member.

13. The gas turbine system of claim 11, further comprising a pivot operatively attaching the flow deflecting member to the outer boundary member.

14. The gas turbine system of claim 11, further comprising a housing positioned about the outer boundary member, wherein the housing is configured to at least partially house the flow deflecting member.

15. The gas turbine system of claim 11, further comprising an actuator in operative communication with the flow deflecting member.

16. The gas turbine system of claim 11, further comprising at least one strut disposed within the exhaust flow path between the outer boundary member and the inner boundary member, wherein the flow deflecting member is positioned downstream of the at least one strut.

17. The gas turbine system of claim 11, wherein the one or more apertures comprise a plurality of holes or slots.

18. The gas turbine system of claim 11, wherein the flow deflecting member comprises one or more protrusions.

* * * * *